United States Patent [19]

Atsumi et al.

[11] Patent Number: 4,603,242

[45] Date of Patent: Jul. 29, 1986

[54] ELECTRICAL SNAP SWITCH

[75] Inventors: Haruo Atsumi, Ohtsu; Ryuichi Sato, Kyoto, both of Japan

[73] Assignee: Omron Tateisi Electronics, Co., Kyoto, Japan

[21] Appl. No.: 604,575

[22] Filed: Apr. 27, 1984

[51] Int. Cl.[4] ..... H01H 21/04; H01H 57/00

[52] U.S. Cl. ..... 200/181; 200/67 D

[58] Field of Search ..... 200/67 D, 181

[56] References Cited

U.S. PATENT DOCUMENTS

| | | | |
|---|---|---|---|
| 2,466,459 | 4/1949 | MacFarland | 200/67 D |
| 2,697,145 | 12/1954 | Winet | 200/67 D |
| 2,835,761 | 5/1958 | Crownover | 200/67 D |
| 3,838,237 | 9/1974 | Hoshioka | 200/67 D |

FOREIGN PATENT DOCUMENTS

| | | | |
|---|---|---|---|
| 552518 | 11/1956 | Belgium | 200/67 D |

*Primary Examiner*—John W. Shepperd

*Attorney, Agent, or Firm*—Wegner & Bretschneider

[57] ABSTRACT

An improved electrical snap switch which includes a housing having a base, a common terminal fixedly provided on the base, a movable piece having a movable contact secured to its one end and an inner plate formed in it to extend from its other end towards the movable contact, with the inner plate being supported, at its forward end, by the common terminal, a plate-like movable spring engaged, at its one end, with the movable piece in the vicinity of the movable contact and at its other end, with a support portion provided adjacent to a base portion of the inner plate, and an operating member engaged with the other end portion of the movable piece.

4 Claims, 7 Drawing Figures

ELECTRICAL SNAP SWITCH

BACKGROUND OF THE INVENTION

The present invention generally relates to an electrical switch and more particularly, to an electrical snap switch which is adapted to selectively close or open an electric path through snap action.

Conventionally, as an electrical switch of the above described type, there has been proposed an arrangement as shown in FIG. 1, in which a forward end of a receiving piece 2 is supported by a common terminal 1 through an edge contact (as at a supporting point A), while a rear end of a movable piece 3 is supported by a corresponding rear end of the receiving plate 2 also through an edge contact (as at a supporting point B) for engagement with a pushbutton 4, with a movable spring 5 being held between a portion in the vicinity of a contact of the movable piece 3 and the common terminal 1 (as at engaging points C and D).

In the known snap switch as referred to above, upon depression of the pushbutton 4, the receiving plate 2 is rotated counterclockwise about the supporting point A, with a pivotal movement of the movable piece 3 about the supporting point D in a counterclockwise direction, and when the supporting point B passes through a line connecting the engaging points C and D, the movable piece 3 is reversed downwardly through a snap action, so that a movable contact 6 is changed over from a normally closed stationary contact *7b* to a normally open stationary contact *7a*. On the other hand, when the pushbutton 4 is released from the depressing force, the movable contact 6 is changed over from the contact *7a* to the contact *7b* in the reverse order to the above.

The prior art switch as described above, however, has such disadvantages that, since the receiving plate 2, the movable piece 3 and the movable spring 5 are combined with each other for engagement with the common terminal 1, holding and assembling of such parts during assembly of the switch are difficult, thus requiring much time and labor therefor.

Moreover, as shown in FIGS. 2 and 3, since the supporting point A is positioned at an outside lower portion of a triangle formed by connecting the engaging point C in a free state, the engaging point C′ in a functioning state and the engaging point D, large forces are required both for the functioning and restoration, and therefore, the switch can not be adapted to function at a small load. Furthermore, due to the fact that a functioning distance L between the supporting point B in the free state and the supporting point B′ in the functioning state can not be reduced by positioning the point B and the point D close to each other because of the presence of thicknesses of the common terminal 1 and receiving plate 2 therebetween, it is difficult to provide an electrical snap switch with a high sensitivity.

In connection with the above, relationship of forces at the points B and C is illustrated in FIG. 3, in which Fs represents a force acting on the movable piece 3 by the movable spring 5, Fe denotes a component force produced in a longitudinal direction of the movable piece 3, Fo shows a force for restoring the receiving plate 2, i.e. the restoring force of the pushbutton 4, Fa is a force directed towards the supporting point A of the receiving plate 2, and Fc represents a force for pressure contact towards the normally closed contact.

SUMMARY OF THE INVENTION

Accordingly, an essential object of the present invention is to provide an improved electrical switch of a high sensitivity capable of functioning at a small load, and preferably one of a construction in which a receiving plate conventionally required for the switch of this type is omitted for reduction of the number of parts involved, and also for simplification of the construction on the whole.

Another important object of the present invention is to provide an electrical switch of the above described type, which is functionally stable at high reliability, and can be readily manufactured on a large scale at low cost.

In accomplishing these and other objects, according to one preferred embodiment of the present invention, there is provided an electrical snap switch which includes a housing having a base, a common terminal fixedly provided on the base, a movable piece having a movable contact secured to one end thereof and an inner plate formed therein to extend from the other end thereof towards the movable contact, with the inner plate being supported, at its forward end, by the common terminal, a plate-like movable spring engaged, at its one end, with the movable piece in the vicinity of the movable contact and at the other end thereof, with a support portion provided adjacent to a base portion of the inner plate, and an operating member engaged with said the other end portion of the movable piece.

By the arrangement according to the present invention as described above, the receiving plate conventionally required for the snap switch of this type has been dispensed with, and the number of parts involved is reduced by that extent for simplification of the construction, with a simultaneous improvement of workability in assembling. Moreover, since the pivotal movement supporting portion of the movable piece is included in the range for the pivotal motion, both the functioning force and restoring force are reduced to achieve functioning at a small load. Furthermore, owing to the construction in which the functioning distance is reduced by disposing the engaging portion at the other end of the movable spring close to the engaging portion of the operating member, a highly sensitive functioning may be achieved.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
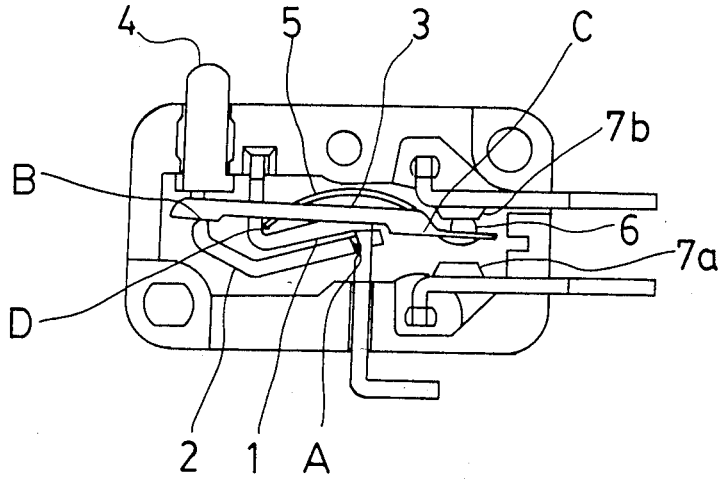
Fig. 1 PRIOR ART
FIG. 1 is a front elevational view of a conventional electrical snap switch (already referred to)
Figure 2:
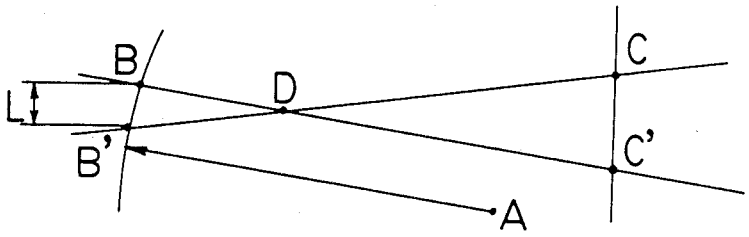
Fig. 2 PRIOR ART
FIGS. 2 and 3 are diagrams explanatory of functioning forces in the switch of FIG. 1 (already referred to)
Figure 3:
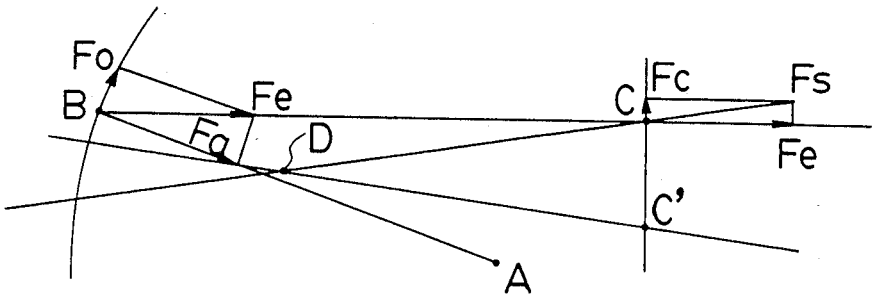
Fig. 3 PRIOR ART

Before the description of the present invention proceeds, it is to be noted that like parts are designated by like reference numerals throughout the accompanying drawings.

Figure 4:
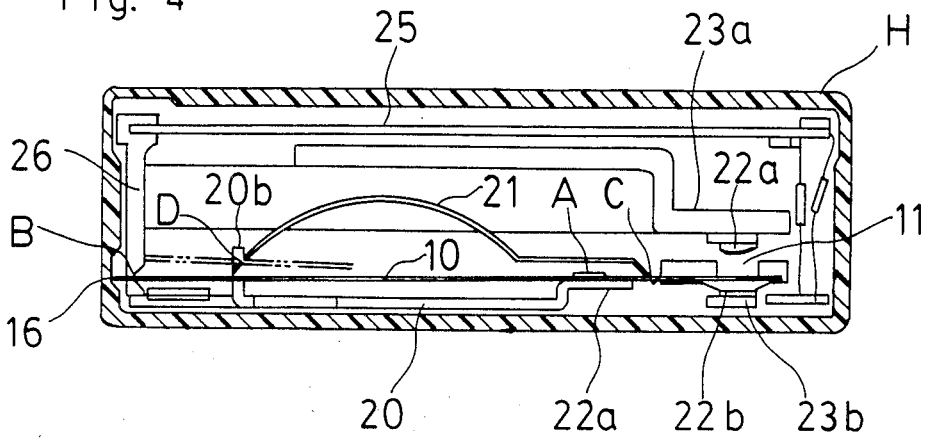
FIG. 4 is a sectional view in a horizontal direction of an electrical switch according to one preferred embodiment of the present invention.
Figure 5:
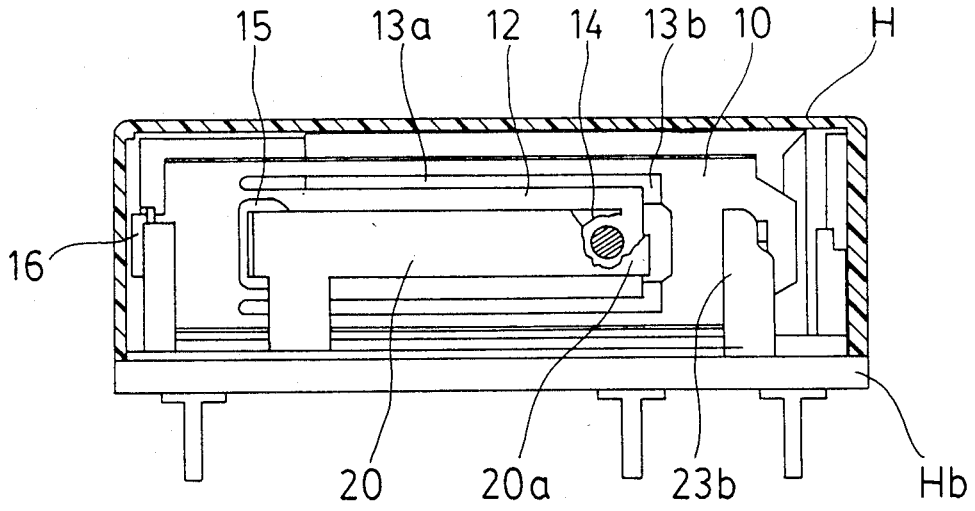
FIG. 5 is also a sectional view in a vertical direction of the switch of FIG. 4.

Referring now to the drawings, there is shown, in FIGS. 4 and 5, an electrical snap switch or microswitch according to one preferred embodiment of the present invention, which generally includes a housing H having a base Hb, a common terminal 20 fixedly provided on the base Hb, a movable piece 10 having a movable contact 11 secured to one end thereof and an inner plate formed therein to extend from the other end thereof towards said movable contact 11 (FIG. 6), a plate-like movable spring 21 engaged, at its one end, with the movable piece 10 in the vicinity of the movable contact 11 and at the other end thereof, with a support portion provided adjacent to a base portion of said inner plate 12, and an operating member 25 engaged with said the other end portion of said movable piece 10.

Figure 6:
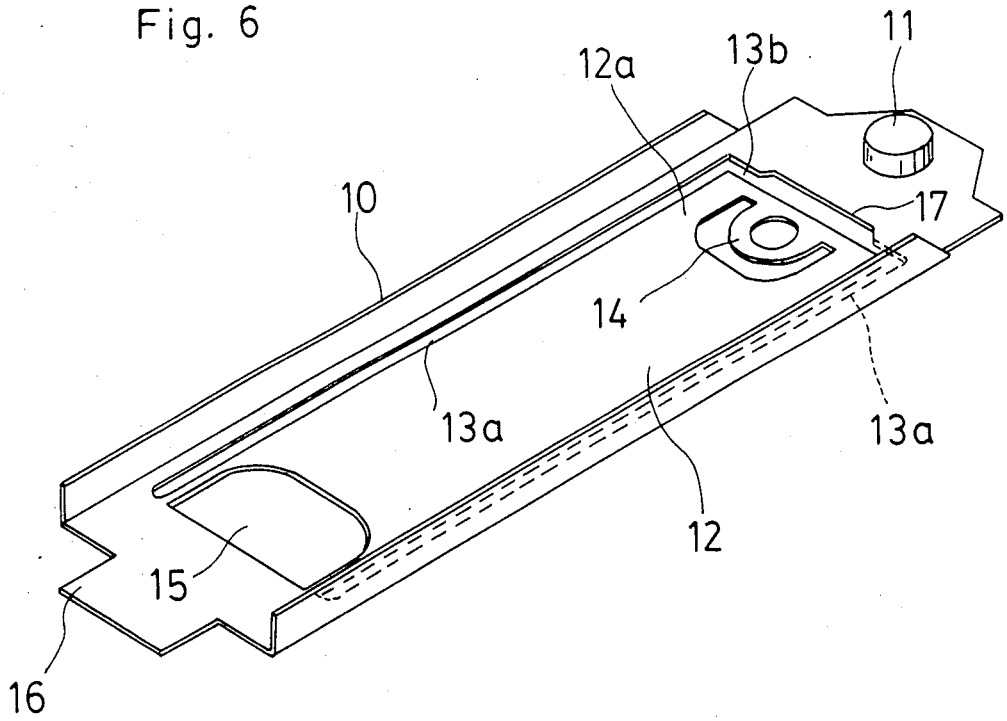
FIG. 6 is a perspective view showing a movable piece employed in the switch of FIG. 4.

The movable piece 10 is prepared, for example, from a sheet of electrically conductive mallic material by press work, and the inner plate 12 thereof is provided by forming continuous slits 13*a* and 13*b* at opposite side edges and a forward end portion of the movable piece 10 so as to be continued onto said movable piece 10 at a base portion thereof as is most clearly seen in FIG. 6.

This movable piece 10 is supported by caulking or staking a tongue piece or lug 14 formed at the distal end portion 12*a* of the inner plate 12 to a corresponding end portion 20*a* of the common terminal 20 (at support point A), and an opening 15 is formed at the base portion of the inner plate 12. By means of this opening moveable member 10 is loosely fitted over a raised portion 20*b* provided at the other end of the common terminal 20, while a projection 16 provided at the other end of the movable member 10 is connected, through a drive transmitting member 26, to a forward end of a known piezoelectric bimorph element 25 which is secured at its rear end to the base Hb (a connecting point B). Meanwhile, the one end of the plate-like actuation of spring 21 is engaged with a stepped portion 17 of the slit 13*b* described earlier (an engaging point C), and the other end thereof is engaged with the raised portion 20*b* of the common terminal 20 through edge engagement (an engaging point D) (FIG. 4).

On the other hand, there are further provided a normally open contact 22*a* and a normally closed contact 22*b* respectively fixed to corresponding terminals 23*a* and 23*b* so as to confront the movable contact 11 of the movable member 10.

In the above arrangement, under a free state, i.e. when the piezoelectric bimorph element 25 is released from voltage impression, the movable piece 10 is urged downwardly about the support point A in FIG. 4 by the spring force of the actuating spring 21, with the movable contact 11 closing the normally closed contact 22*b*.

The piezoelectric bimorph element 25 is displaced upwardly in FIG. 4 upon application thereto of a predetermined voltage, and a lifting force is applied to the connecting point B through the drive transmitting member 26, with the inner plate 12 being pivoted upwardly about the supporting point A. Thus, when the rear portion of the movable piece 10 has passed through a straight line connecting the engaging portions C and D, the movable piece 10 itself is reversed upwardly, with the movable contact 11 being changed over to the normally open contact 22*a*. On the other hand, when the piezoelectric bimorph element 25 is released from the voltage impression thereto, the movable piece 10 is returned in the reverse order to the above, and the movable contact 11 thereof is changed over to the normally closed contact 22*b*.

As is clear from the foregoing description on the construction and operation, according to the snap switch of the present invention, the inner plate 12 of the movable piece 10 functions as a part equivalent to the receiving plate in the conventional snap switch. Accordingly, the number of parts employed is reduced for facilitation of combination of parts during assembling.

Figure 7:
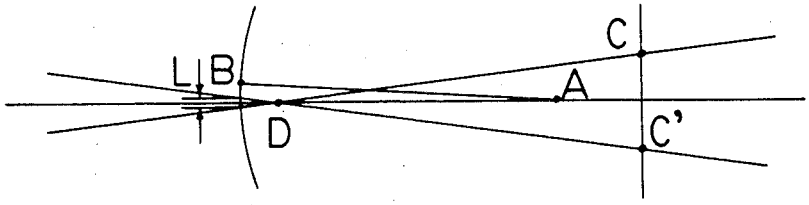
FIG. 7 is a diagram explanatory of functioning forces in the switch of FIG. 4.

Particularly, since the inner plate extends in a direction towards the contact 11, the supporting point A is positioned within a triangle ΔC'D as shown in FIG. 7, and thus both the functioning force and restoring force are reduced to make it possible for the switch to function at a small load. Moreover, since the connecting portion B may be provided close to the engaging portion D, the functioning distance L can be decreased thereby for a marked improvement of sensitivity. Therefore, even when the piezoelectric bimorph element 25 has small functioning force and displacing force, it is possible to fully drive the movable piece 10 for efficient opening and closing of the contacts.

It should be noted here that the snap switch according to the present invention is not limited to the foregoing embodiment alone, but may be modified in various ways within the scope of the invention. For example, the hinged engaging point D at the other end of the movable spring 21 may be formed by causing a part of the housing H to project, instead of utilizing the raised portion 20*b* of the common terminal 20. Meanwhile, although the inner plate 12 is described as fixed to the forward end 20*a* of the common terminal 20 by caulking or staking in the foregoing embodiment, the arrangement may be so modified as to form the forward end 20*a* into a raised portion for an edge engagement. By employing the edge engagement as above, it becomes possible to move the movable piece 10 still more smoothly for a further reduction of the functioning load. Furthermore, the piezoelectric bimorph element 25 may be replaced by a conventional operating member such as a pushbutton, etc.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An electrical switch comprising;

a housing having a base, a common terminal fixedly mounted on and extending longitudinally of said base within said housing, a movable member having an inner plate and an outer plate, horizontal surfaces extending longitudinally of said housing, and first and second ends, a movable contact carried on said outer plate second end, wherein said inner plate extends from said first end towards said second end, wherein said inner plate is attached to said common terminal at a point which is proximate to said second end of said movable member, actuating spring means engaged at one end thereof with said movable member outer plate second end adjacent to said movable member contact and at the other end thereof to a second engaging point fixed with respect to said housing, and an operating member for reciprocally engaging said first end of said movable member, the point of engagement of said operating member with said movable member being in proximity to said fixed point with respect to said housing.

2. An electrical switch as claimed in claim 1 further including a normally open contact and a normally closed contact respectively fixed to corresponding terminals provided on said base, so as to confront said movable contact of said movable piece.

3. An electrical switch as claimed in claim 1, wherein said operating member is a piezoelectric bimorph element associated, at its forward end, with said the other end portion of said movable piece through a drive transmitting member.

4. An electrically actuated switch comprising:

a housing having a base, a common terminal fixedly mounted on and extending longitudinally of said based within said housing, a movable member having an inner plate and an outer plate, horizontal surfaces extending longitudinally of said housing and first and second ends, a movable contact carried on said outer plate second end, wherein said inner plate extends from said first end towards said second end, wherein said inner plate is attached to said common terminal at a point which is proximate to said second end of said movable member, actuating spring means engaged at one end thereof with said movable member outer plate second end adjacent to said movable member contact and at the other end thereof to a second engaging point fixed with respect to said housing, an operating member arranged orthogonally of said movable member first end for reciprocally engaging said first end of said movable member, the point of engagement of said operating member with said movable member being in proximity to said fixed point with respect to said housing, and electrically-operated actuating means for driving said operating member and arranged in said housing in parallel with said movable member.

* * * * *